US010935205B2

(12) United States Patent
Huang et al.

(10) Patent No.: US 10,935,205 B2
(45) Date of Patent: Mar. 2, 2021

(54) LIGHT SOURCE, REFLECTION LUMINAIRE AND AUTOMOTIVE HEADLAMP

(71) Applicant: Lumileds Holding B.V., Schiphol (NL)

(72) Inventors: Ying Huang, Shanghai (CN); Jimmy Xiao, Shanghai (CN); Shengjin Chen, Shanghai (CN)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/720,461

(22) Filed: Dec. 19, 2019

(65) Prior Publication Data

US 2020/0200353 A1 Jun. 25, 2020

(30) Foreign Application Priority Data

Dec. 20, 2018 (WO) ..... PCT/CN2018/122266
Jan. 17, 2019 (EP) ..... 19152257

(51) Int. Cl.

| | |
|---|---|
| ***F21V 9/16*** | (2006.01) |
| ***F21S 41/43*** | (2018.01) |
| ***F21S 41/147*** | (2018.01) |
| ***F21S 41/36*** | (2018.01) |

(52) U.S. Cl.
CPC ..... *F21S 41/43* (2018.01); *F21S 41/147* (2018.01); *F21S 41/36* (2018.01)

(58) Field of Classification Search
CPC ..... F21S 41/43; F21S 41/147; F21S 41/36
USPC ..... 362/516
See application file for complete search history.

(56) References Cited

U.S. PATENT DOCUMENTS

| | | | | |
|---|---|---|---|---|
| 7,736,039 | B2 * | 6/2010 | Nakazawa | F21S 41/151 362/544 |
| 8,376,598 | B2 * | 2/2013 | Kondo | F21S 41/155 362/516 |
| 8,888,344 | B2 * | 11/2014 | Tatsukawa | F21S 41/148 362/518 |
| 10,655,809 | B1 * | 5/2020 | Juneau | F21S 41/147 |
| 10,697,606 | B1 * | 6/2020 | Fredricks | F21S 41/336 |

(Continued)

FOREIGN PATENT DOCUMENTS

| | | |
|---|---|---|
| DE | 102014107130 A1 | 4/2015 |
| EP | 1770793 A2 | 4/2007 |

(Continued)

OTHER PUBLICATIONS

EP Application No. 19152257.2, "Extended EP Search Report and Written Opinion," dated Jul. 8, 2019, 8 pages.

(Continued)

*Primary Examiner* — Ali Alavi

(57) ABSTRACT

A light source (210, 310) for a reflection luminaire, a reflection luminaire (200, 300) for an automobile and an automotive headlamp comprising the reflection luminaire (200, 300) are disclosed. The light source (210, 310) comprises a substrate (212), and a light emitting component (214), being a Chip Scale Package light emitting diode, and a light absorbing component (216) on the substrate (212). The light absorbing component (216) is configured to absorb light which is emitted from a side surface of the light emitting component (214) and incident on a surface of the substrate (212). The light source facilitates reducing or eliminating glare of a CSP LED reflection luminaire for an automobile.

13 Claims, 2 Drawing Sheets

(56) References Cited

U.S. PATENT DOCUMENTS

| | | | | |
|---|---|---|---|---|
| 2005/0068787 | A1* | 3/2005 | Ishida | F21S 41/663 362/538 |
| 2017/0059116 | A1* | 3/2017 | Huang | F21S 45/10 |
| 2017/0356616 | A1 | 12/2017 | Schiccheri et al. | |
| 2018/0066819 | A1 | 3/2018 | Chen et al. | |

FOREIGN PATENT DOCUMENTS

| | | | |
|---|---|---|---|
| EP | 3324104 | A1 | 5/2018 |
| JP | 2012089316 | A | 5/2012 |

OTHER PUBLICATIONS

From the EPO as the ISA, Notification of Transmittal of the International Search Report and the Written Opinion of the International Searching Authority, PCT/EP2019/084669, dated Feb. 19, 2020, 14 pages.

* cited by examiner

LIGHT SOURCE, REFLECTION LUMINAIRE AND AUTOMOTIVE HEADLAMP

CROSS REFERENCE TO RELATED APPLICATIONS

This application claims priority to International Application No. PCT/CN2018/122266 filed Dec. 20, 2018 and titled "LIGHT SOURCE, REFLECTION LUMINAIRE AND AUTOMOTIVE HEADLAMP," and European Patent Application No. 19152257.2 filed on Jan. 17, 2019, and titled "LIGHT SOURCE, REFLECTION LUMINAIRE AND AUTOMOTIVE HEADLAMP." Both PCT/CN2018/122266 and EP 19152257.2 are incorporated herein by reference.

TECHNICAL FIELD

The present disclosure relates to the field of light sources, and particularly to a light source for a reflection luminaire, a reflection luminaire for an automobile and an automotive headlamp comprising the reflection luminaire.

BACKGROUND

An automotive headlamp generally includes a reflection luminaire, and the reflection luminaire typically includes a reflector and a light source at or near the focal point of the reflector. Most of such light sources are halogen lamps. High Intensity Discharge (HID) lamps are adopted in some high-end automobiles. Recently, light-emitting diode (LED) lamps have been applied as the light source for the automotive headlamp. However, LED lamps bring about side effects like glare in the headlamp. There is a need to provide an improved automotive headlamp to mitigate or avoid these side effects.

SUMMARY

It is an object of the present disclosure to provide a light source, a reflection luminaire, and an automotive headlamp in which side effects caused by the LED lamps are mitigated or avoided.

In one aspect of the present disclosure, there is provided a light source for a reflection luminaire, comprising a substrate, and a light emitting component and a light absorbing component on the substrate. In embodiments of the present disclosure, the light absorbing component is configured to absorb light which is emitted from a side surface of the light emitting component and incident on a surface of the substrate. In this arrangement, the light output from the side surfaces of the light emitting component and incident on the surface of the substrate is at least partially absorbed, or even completely absorbed. Accordingly, there is no reflection from the surface of the substrate, and thus glare is prevented.

The light emitting component is a Chip Scale Package (CSP) light emitting diode.

In an exemplary embodiment, an orthogonal projection of the light absorbing component on the surface of the substrate comprises a portion which surrounds and is adjacent to an orthogonal projection of the light emitting component on the surface of the substrate.

In an exemplary embodiment, the light absorbing component and the light emitting component are stacked on the surface of the substrate in this order.

In an exemplary embodiment, the surface of the substrate comprises a recessed portion, and the light absorbing component is accommodated in the recessed portion. This facilitates a thin profile of the light source.

In an exemplary embodiment, the orthogonal projection of the light emitting component on the surface of the substrate falls within the orthogonal projection of the light absorbing component on the surface of the substrate.

In an exemplary embodiment, the orthogonal projection of the light emitting component on the surface of the substrate is surrounded by and adjacent to the orthogonal projection of the light absorbing component on the surface of the substrate.

In an exemplary embodiment, the portion of the orthogonal projection of the light absorbing component on the surface of the substrate has a width in a direction which is in a plane parallel with the surface of the substrate and perpendicular to a side of the light emitting component, the light emitting component has a thickness in a direction perpendicular to the surface of the substrate, and the width of the light absorbing component is 2-3 times the thickness of the light emitting component. In this way, the majority, if not all, of light output from the side surfaces of the light emitting component is incident on the light absorbing component, and thus is absorbed.

In an exemplary embodiment, the width has a value in a range of 0.8 mm-1.2 mm, and preferably has a value of 1 mm.

In an exemplary embodiment, the substrate is a printed circuit board (PCB), and the light absorbing component is a silk screen region of on the printed circuit board. Since the bare PCB comprises the silk screen region (black zone), the proposed light source is easy to implement.

In another aspect of the present disclosure, there is provided a reflection luminaire for an automobile, comprising the light source as described above, a first light directing component and a second light directing component. The first light directing component is configured to receive light from the light source and project the light onto the second light directing component. The second light directing component is configured to project the light projected by the first light directing component to a side of the second light directing component away from the first light directing component.

In an exemplary embodiment, the first light directing component comprises an ellipsoidal reflective bowl or a collimator.

In an exemplary embodiment, the second light directing component comprises an aspheric lens.

In a further aspect of the present disclosure, there is provided an automotive headlamp, comprising the reflection luminaire as described above.

BRIEF DESCRIPTION OF THE DRAWINGS

The above and other aspects of the present disclosure will now be described in more detail with reference to the accompanying drawings that illustrate exemplary embodiments of the present disclosure, in which.

DETAILED DESCRIPTION

Embodiments of the present disclosure will be described more fully hereinafter with reference to the accompanying drawings. The present disclosure may, however, be embodied in many different forms and should not be construed as limited to the embodiments set forth herein.

Figure 1A:
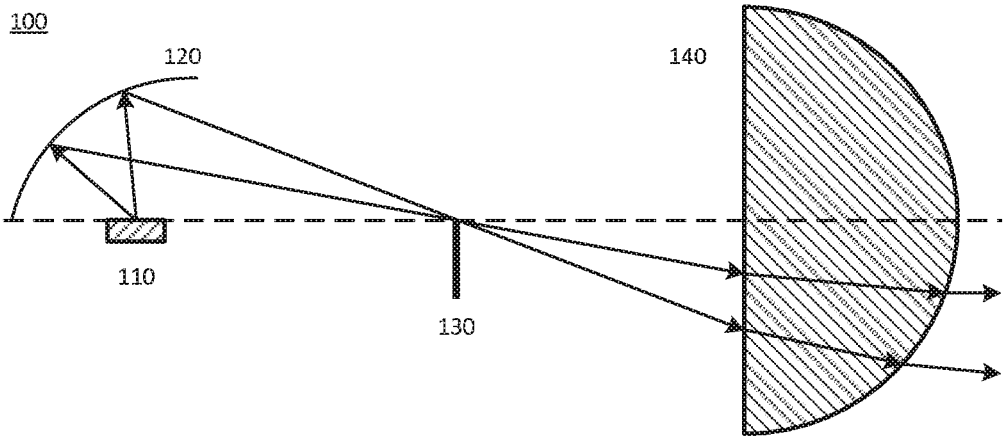
FIG. 1*a* is a schematic diagram for illustrating a conventional reflection luminaire for an automobile.

FIG. 1*a* schematically shows a conventional reflection luminaire for an automobile. The reflection luminaire 100 comprises a light source 110, a first light directing component 120, a shielding component 130, and a second light directing component 140.

The first light directing component 120 receives light from the light source 110 and projects the light onto the second light directing component 140. The second light directing component 140 projects the light projected by the first light directing component 120 to a side of the second light directing component 140 away from the first light directing component 120. The first light directing component 120 can be a reflector with a light-directing interior surface which is usually poly-ellipsoidal in shape. The light-directing interior surface may be parabolic in shape, or may have other shapes. The first light directing component 120 is configured to shape light emitted by the light source 110 into a high beam and a low beam, in combination with the second light directing component 140, or not in combination with the second light directing component 140.

A shielding component 130 can be arranged between the first light directing component 120 and the second light directing component 140. The shielding component 130 partially blocks the light coming from the light source 110 in the low beam mode, and edges of the shielding component 130 are used to generate a bright/dark cut-off line of the low-beam pattern.

CSP has recently made inroads into the LED industry, due to its advantages of better thermal contact to the substrate through metal-metal interface of the bottom epi-layer to the heat sink, higher current densities, high reliability, higher packaging density due to reduced footprint, and ease of integration on boards through surface mount technology. A CSP LED can be directly attached to Level 2 boards. Therefore, the CSP LED is a competitive candidate for a LED light source in an automotive headlamp.

Figure 1B:
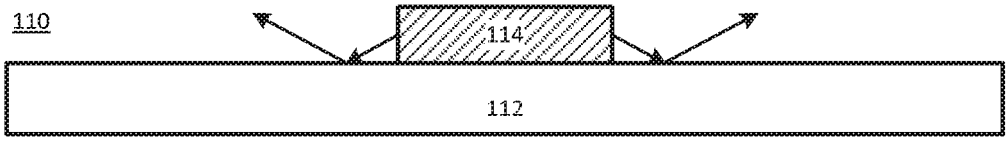
FIG. 1*b* is a schematic diagram for illustrating a CSP LED light source.

In a common design of the CSP LED, light is usually extracted from the top surface and four side surfaces of the LED. FIG. 1*b* schematically shows a CSP LED light source 110 in which the light emitting component 114 is a CSP LED and mounted on a substrate 112. As shown by arrows in the figure, some light exits from the side surfaces at a negative angle with respect to the top surface of the light emitting component 114. This light is emitted from the side surfaces of the light emitting component 114 and then incident on a surface of the substrate 112. As found by the inventors, when the CSP LED light source of FIG. 1*b* is applied to an automotive headlamp, glare appears in the automotive headlamp due to the light reflected from the surface of the substrate 112. In addition, the cut-off line of the low beam pattern is less sharp.

Figure 2A:
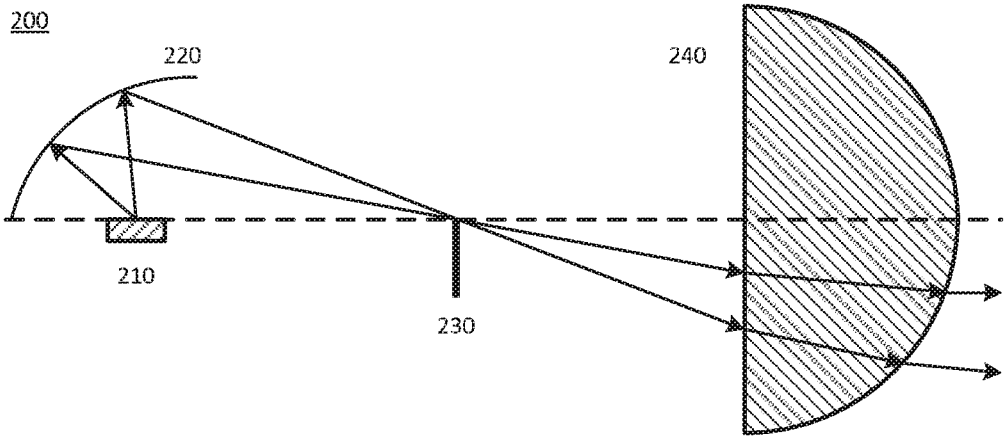
FIG. 2*a* is a schematic diagram for illustrating a reflection luminaire for an automobile in an embodiment of the present disclosure.

FIG. 2*a* schematically shows a reflection luminaire 200 for an automobile in an embodiment of the present disclosure. The reflection luminaire 200 comprises a light source 210, a first light directing component 220, and a second light directing component 240. Optionally, the reflection luminaire 200 further comprises a shielding component 230 between the first light directing component 220 and the second light directing component 240. The second light directing component 240 may comprise an aspheric lens. Reference can be made to the description about components in the reflection luminaire 100 in FIG. 1*a* for details of components in the reflection luminaire 200, which are not repeated for simplicity.

The reflection luminaire 200 of FIG. 2*a* mainly differs from the reflection luminaire 100 of FIG. 1*a* in the light source 210. Hereinafter, the light source 210 will be described in detail by referring to FIGS. 2*b*, 2*c*, 2*d*, and 2*e*, in which FIGS. 2*b*, 2*c*, 2*d* are cross-sectional views taken along the line A-A' in FIG. 2*e*.

Figure 2B:
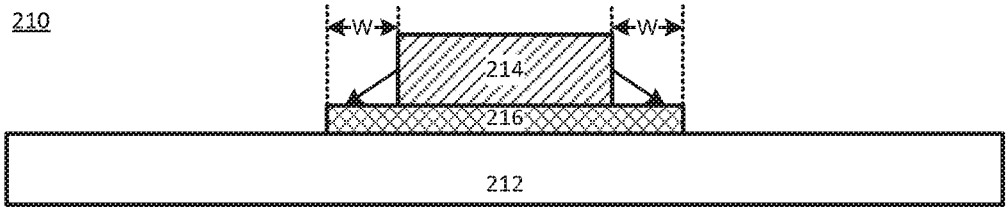
FIG. 2*b* is a cross-sectional view for illustrating a light source in an embodiment of the present disclosure.

FIG. 2*b* schematically shows the light source 210 in an embodiment of the present disclosure in a cross-sectional view. The light source 210 comprises a light absorbing component 216 on the substrate 212. The light absorbing component 216 is configured to absorb light which is emitted from the side surfaces of the light emitting component 214 and incident on a surface of the substrate 212. An orthogonal projection of the light absorbing component 216 on the surface of the substrate 212 comprises a portion which surrounds and is adjacent to an orthogonal projection of the light emitting component 214 on the surface of the substrate 212. Due to the arrangement of the light absorbing component 216, the light output from the side surfaces of the light emitting component 214 and incident on the surface of the substrate 212 is at least partially absorbed, or even completely absorbed. In this way, there is no reflection from the surface of the substrate 212, and thus glare is prevented.

Figure 2C:
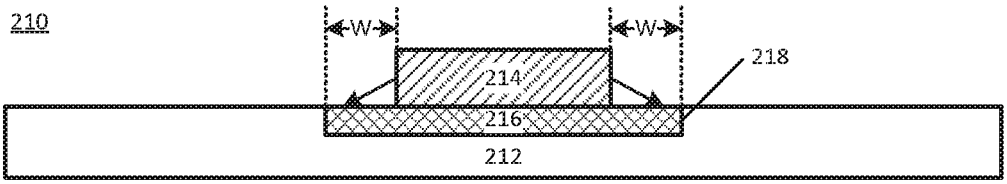
FIG. 2*c* is a cross-sectional view for illustrating a light source in an embodiment of the present disclosure.
Figure 2D:
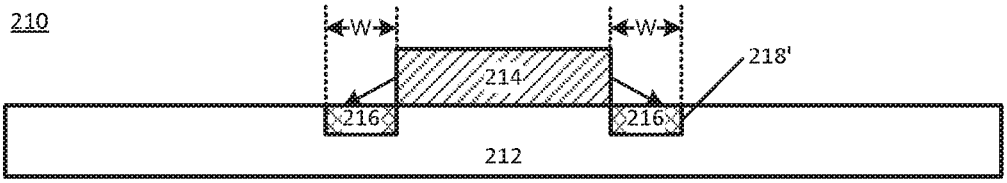
FIG. 2*d* is a cross-sectional view for illustrating a light source in an embodiment of the present disclosure.

FIG. 2*c* schematically shows a variant of the light source 210 of FIG. 2*b* in a cross-sectional view.

As shown in FIGS. 2*b* and 2*c*, the light absorbing component 216 and the light emitting component 214 are stacked on the surface of the substrate 212 in this order. The orthogonal projection of the light emitting component 214 on the surface of the substrate 212 falls within the orthogonal projection of the light absorbing component 216 on the surface of the substrate 212. In this configuration, the bottom surface of the light emitting component 214 is smaller than the (top) surface of the substrate 212. In this way, there is a chance for the light output from the side surfaces of the light emitting component 214 at a negative angle to be incident on the light absorbing component 216, and thus is at least partially absorbed, or even completely absorbed.

Figure 2E:
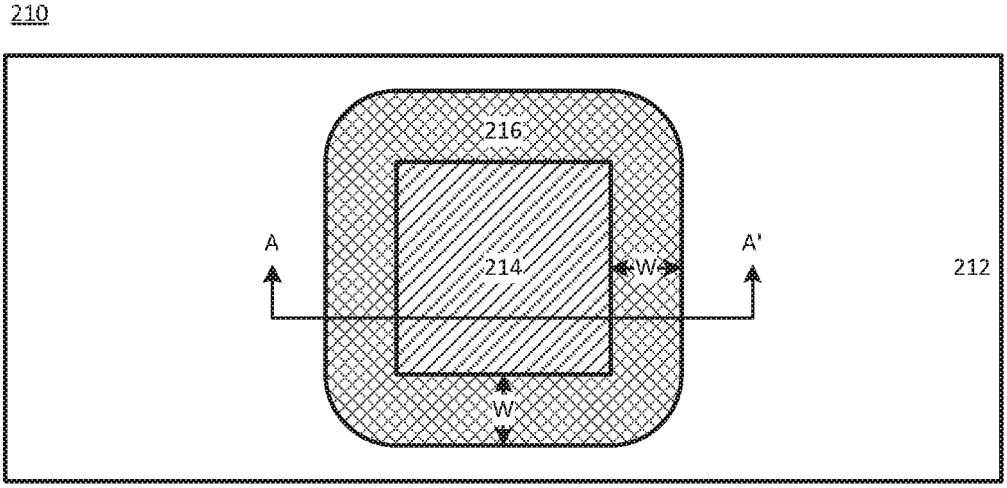
FIG. 2*e* is a top view for illustrating a light source in an embodiment of the present disclosure.

As shown in the top view of FIG. 2*e*, the portion of the orthogonal projection of the light absorbing component 216 on the surface of the substrate 212 has a width W in a direction which is in a plane parallel with the surface of the substrate 212 and perpendicular to a side of the light emitting component 214.

In the case of FIGS. 2*b* and 2*c*, in a direction in a plane parallel with the surface of the substrate 212 and perpendicular to the side surfaces of the light emitting component 214, the light absorbing component 216 extends from the side surfaces of the light emitting component 214 by the width W.

The light emitting component 214 has a thickness in a direction perpendicular to the surface of the substrate 212. In embodiments of the present disclosure, the width W of the light absorbing component 216 is about 2-3 times the thickness of the light emitting component 214, so that the majority of light output from the side surfaces of the light emitting component 214 at a negative angle is incident on the light absorbing component 216, and thus is absorbed.

In a preferred embodiment, the thickness of the light emitting component 214 is about 0.4 mm, and the width W has a value in a range of about 0.8 mm-1.2 mm, and preferably has a value of 1 mm.

In the variant shown in FIG. 2*c*, the surface of the substrate 212 comprises a recessed portion 218, and the light absorbing component 216 is accommodated in the recessed portion 218.

In the variant shown in FIG. 2*d*, the surface of the substrate 212 comprises a recessed portion 218', and the light absorbing component 216 is accommodated in the recessed portion 218'. The orthogonal projection of the light emitting component 214 on the surface of the substrate 212 is surrounded by the orthogonal projection of the light absorbing component 216 on the surface of the substrate 212. In a preferred embodiment, the orthogonal projection of the light emitting component 214 on the surface of the substrate 212 is adjacent to the orthogonal projection of the light absorbing component 216 on the surface of the substrate 212. In this case, the width W by which the orthogonal projection of the light absorbing component 216 extends from the orthogonal projection of the light emitting component 214 is defined by a width of the recessed portion 218'.

In an embodiment of the present disclosure, the substrate 212 is a printed circuit board (PCB), and the light absorbing component 216 is a silk screen region (black zone) on the printed circuit board. This means that the light absorbing component 216 is a black printing on the white background of the PCB. There is no need to assemble any foreign material or accessory. In this way, the process for the light absorbing component 216 can be accomplished in the PCB manufactory.

Figure 3:
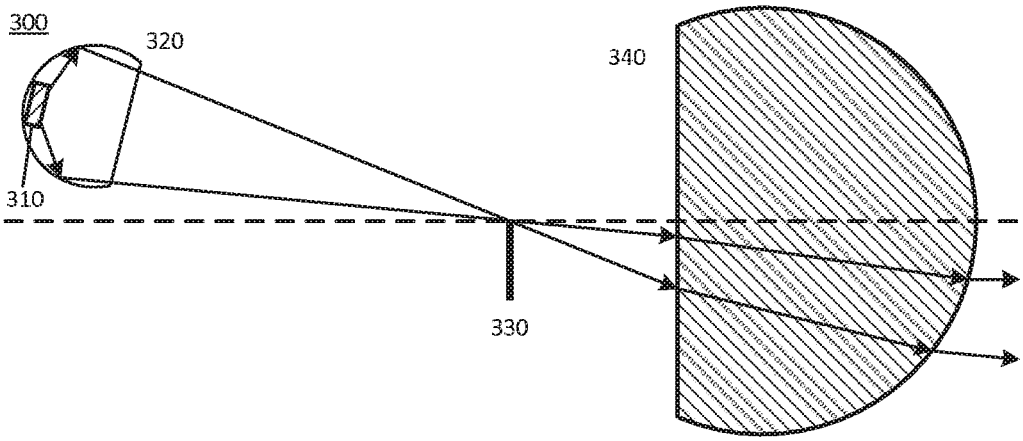
FIG. 3 is a schematic diagram for illustrating a reflection luminaire for an automobile in an embodiment of the present disclosure.

In the embodiments as described above, reference is made to a case in which the first light directing component is a reflector with a light-directing interior surface like an ellipsoidal reflective bowl. The present disclosure is not limited in this regard. As shown in FIG. 3, in an embodiment of the present disclosure, a reflection luminaire 300 for an automobile comprises a light source 310, a first light directing component 320, an optional shielding component 330, and a second light directing component 340. In this embodiment, the first light directing component 320 is a collimator which is configured to shape light emitted by the light source 310 into a low beam, in combination with the second light directing component 340, or not in combination with the second light directing component 340.

Inventors have tested CSP LED light sources in a reflection headlamp. When a H7 CSP LED with the configuration of FIG. 1*b* is applied to the reflection luminaire 100, the glare is about 580 cd and fails the specification in ECE regulations in which it is required that the glare shall be not larger than 420 cd. When the H7 CSP LED configuration of FIGS. 2*b*-2*d* is applied to the reflection luminaire 200, the glare is about 380 cd and passes the specification.

In embodiments of the present disclosure, an automotive headlamp is proposed, which comprises the reflection luminaire as described in the above embodiments.

Although some exemplary embodiments of the present disclosure have been described in the above description, other variations to the disclosed embodiments can be understood and effected by those skilled in the art in practicing the claimed invention from a study of the drawings, the disclosure, and the appended claims. For example, although the light source of the present disclosure has been described with reference to a case in which it is applied to the reflection luminaire in the low beam mode, the light source of the present disclosure can also be applied to the reflection luminaire in the high beam mode. Furthermore, in the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

LIST OF REFERENCE NUMERALS

100, 200, 300: reflection luminaire;
110, 210, 310: light source;
112, 212: substrate;
114, 214: light emitting component;
216: light absorbing component;
218, 218': recessed portion;
120, 220, 320: first light directing component;
130, 230, 330: shielding component;
140, 240, 340: second light directing component;
W: width.

The invention claimed is:

1. A light source for a reflection luminaire, comprising
a substrate,
a light emitting component having a first surface, an oppositely positioned second surface, side surfaces connecting the first and second surfaces, and a thickness perpendicular to the first surface, the light emitting component comprising a light emitting diode, and
a light absorbing component on a surface of the substrate, the light absorbing component configured to absorb light emitted from one or more of the side surfaces of the light emitting component, an orthogonal projection of the light absorbing component on the surface of the substrate comprising
a portion surrounding and adjacent to an orthogonal projection of the light emitting component on the surface of the substrate, and
a width 2 to 3 times the thickness of the light emitting component.

2. The light source of claim 1, wherein the substrate is a printed circuit board (PCB), and the light absorbing component is a silk screen region on the printed circuit board.

3. The light source of claim 1, wherein the light absorbing component and the light emitting component are stacked on the surface of the substrate in this order.

4. The light source of claim 1, wherein the surface of the substrate comprises a recessed portion, and the light absorbing component is accommodated in the recessed portion.

5. The light source of claim 1, wherein the orthogonal projection of the light emitting component on the surface of the substrate falls within the orthogonal projection of the light absorbing component on the surface of the substrate.

6. The light source of claim 1, wherein the orthogonal projection of the light emitting component on the surface of the substrate is surrounded by and adjacent to the orthogonal projection of the light absorbing component on the surface of the substrate.

7. The light source of claim 1, wherein the width of the orthogonal projection of the light absorbing component has a value in a range of 0.8 mm-1.2 mm.

8. The light source of claim 7, wherein the width of the orthogonal projection of the light absorbing component has a value of 1 mm.

9. A reflection luminaire for an automobile, comprising the light source of claim 1, a first light directing component and a second light directing component, wherein the first light directing component is configured to receive light from the light source and project the light onto the second light directing component, and wherein the second light directing component is configured to project the light projected by the first light directing component to a side of the second light directing component away from the first light directing component.

10. The reflection luminaire of claim 9, wherein the first light directing component comprises an ellipsoidal reflective bowl or a collimator.

11. The reflection luminaire of claim 9, wherein the second light directing component comprises an aspheric lens.

12. An automotive headlamp, comprising the reflection luminaire of claim 9.

13. The light source of claim 1, wherein the light emitting component is a Chip Scale Package light emitting diode.

* * * * *